US005573559A

United States Patent [19]

Hilliard et al.

[11] Patent Number: 5,573,559

[45] Date of Patent: Nov. 12, 1996

[54] METHOD FOR MUNICIPAL WASTE GASIFICATION

[75] Inventors: Wesley P. Hilliard, Huntington; Scott Barney, Ferron, both of Utah

[73] Assignee: Emery Recycling Corporation, Castle Dale, Utah

[21] Appl. No.: 546,294

[22] Filed: Oct. 20, 1995

Related U.S. Application Data

[60] Division of Ser. No. 222,625, Apr. 4, 1994, Pat. No. 5,484,465, which is a continuation-in-part of Ser. No. 100,249, Aug. 2, 1993, abandoned.

[51] Int. Cl.[6] ..... C10J 3/14

[52] U.S. Cl. ..... 48/203; 48/197 R; 48/209

[58] Field of Search ..... 48/76, 111, 69, 48/203, 207, 209, 202, 66, 68, 88.1, 88.2, 86 R, 87, 197 R, 197 A; 110/229

[56] References Cited

U.S. PATENT DOCUMENTS

| | | | |
|---|---|---|---|
| 927,418 | 6/1909 | Pettibone . | |
| 1,849,279 | 3/1932 | Cezanne . | |
| 1,899,158 | 2/1933 | Koller . | |
| 2,143,017 | 1/1939 | Koppers . | |
| 2,306,030 | 12/1942 | Zeuch | 48/76 |
| 2,805,188 | 9/1957 | Josenhans | 202/9 |
| 2,890,107 | 6/1959 | Flesch et al. | 48/206 |
| 3,471,275 | 10/1969 | Borggreen | 48/209 |
| 3,707,129 | 12/1972 | Kawashimo et al. | 110/15 |
| 3,746,521 | 7/1973 | Giddings | 48/111 |
| 3,874,116 | 4/1975 | White | 48/209 |
| 3,918,374 | 11/1975 | Yamamoto et al. | 110/8 E |
| 4,142,867 | 3/1979 | Kiener | 48/76 |
| 4,152,122 | 5/1979 | Feldmann | 48/111 |
| 4,235,675 | 11/1980 | Bechthold | 48/209 |
| 4,306,506 | 12/1981 | Rotter | 110/229 |
| 4,308,807 | 1/1982 | Stokes | 110/257 |
| 4,309,195 | 1/1982 | Rotters | 48/76 |
| 4,459,136 | 7/1984 | Linneborn et al. | 48/111 |
| 4,530,702 | 7/1985 | Fetters et al. | 48/209 |
| 4,718,362 | 1/1988 | Santén et al. | 110/346 |
| 4,732,091 | 3/1988 | Gould | 110/229 |
| 4,977,840 | 12/1990 | Summers | 110/346 |
| 5,069,765 | 12/1991 | Lewis | 204/173 |
| 5,089,030 | 2/1992 | Michel-Kim | 48/76 |
| 5,138,957 | 8/1992 | Morey et al. | 110/234 |
| 5,213,051 | 5/1993 | Kaneko | 110/229 |
| 5,226,927 | 7/1993 | Rundstrom | 48/76 |
| 5,230,716 | 7/1993 | Notestein | 48/62 R |

FOREIGN PATENT DOCUMENTS 981.771 5/1951 France .

OTHER PUBLICATIONS

Gas Producers, pp. 1–13.

*Primary Examiner*—Peter Kratz
*Attorney, Agent, or Firm*—Madson & Metcalf

[57] ABSTRACT

Apparatus and method for gasification of waste are disclosed. Waste material is fed to the top of a first combustion chamber, and a burning, rotating annular column of waste is supported in the combustion chamber. Combustion air is introduced to the first combustion chamber at or below the support for the burning annular column of waste so that the combustion air moves upwardly through the burning column. Combustion gases are withdrawn from the top portion of the first combustion chamber. Particulates are removed and recirculated to the first combustion chamber. The combustion gases are then fed to the top portion of a second combustion chamber. Secondary combustion air and optional fuel are fed to the second combustion chamber to complete the gasification process. A relatively clean producer gas is withdrawn from the bottom portion of the secondary combustion chamber.

13 Claims, 10 Drawing Sheets

*Fig. 1*

METHOD FOR MUNICIPAL WASTE GASIFICATION

BACKGROUND OF THE INVENTION

1. Related Application

This application is a divisional of application Ser. No. 08/222,625, filed on Apr. 4, 1994, now U.S. Pat. No. 5,484,465 entitled APPARATUS AND METHOD FOR MUNICIPAL WASTE GASIFICATION, which application is a continuation-in-part of application Ser. No. 08/100,249 filed Aug. 2, 1993, now abandoned and entitled "APPARATUS AND METHOD FOR GASIFICATION OF COMMON, MUNICIPAL WASTE," which application is incorporated herein by this reference.

2. Field of the Invention

The present invention relates generally to a practical method and apparatus for treating waste material, including municipal, industrial, construction, and agricultural waste, to reduce the disposal volume of the solid waste and to produce a clean producer gas that can be recovered for use in various applications or can be burned to yield a non-polluting off-gas. In particular, the present invention relates to a process for controlled thermo-gasification of waste materials wherein the waste is subjected to a two step gasification process which utilizes two separate and distinct gasification chambers that are operated in series. As a result of the process of the present invention, the waste material is reduced in volume by at least 80 percent, and a clean producer gas is produced without creating any adverse effect on the environment.

3. Technology Background

Disposal of waste materials has been and continues to be a major problem in our society. The quantity of solid waste is ever increasing, and the land needed for conventional landfills is rapidly disappearing. Landfills in and of themselves present problems. Refuse deposited in landfills takes over 30 years to decompose. During that period other ecological problems are generated. Pollutants leaching from the refuse into the water table have become a significant concern, and the problems of odors and atmospheric pollution are numerous. Of further concern is the fact that the disposal of solid waste in a landfill has often resulted in unexpected long term hazards due to ground pollution caused by the nature of the waste as well as due to uneven settling of the landfill site long after the landfill has been converted to other uses.

The most widely used alternative to landfill waste disposal is incineration in open air or in forced air incineration plants. Conventionally, in the course of incineration, burning of the refuse is carried out in a combustion chamber into which air is introduced for purposes of combustion. As part of the incineration, the organic materials from the waste material must be converted into materials that will burn uniformly in the combustion chamber. Unfortunately, solid waste materials vary so widely in composition and in its moisture content that the combustion reaction cannot be adequately controlled and maintained. Incomplete combustion of the waste is common, with resulting emission to the atmosphere of large quantities of smoke and pollution. Even though it is desirable to incinerate or burn solid waste to reduce its volume, neither open air burning nor forced air incineration is environmentally acceptable because of the air pollution problems inherent with the processes.

Numerous systems have been proposed for pyrolysis and gasification of waste materials. While pyrolysis techniques offer a number of theoretical advantages, pyrolysis systems for handling common waste have not achieved any significant commercial use. This failure of pyrolysis technology to achieve an acceptable status in the art of disposing of solid waste materials involves at least in part certain heat transfer problems incurred due to the large variance in composition and moisture content of the waste.

For example, to achieve relatively steady state operation when gasifying common municipal waste, temperatures for pyrolysis must be used that approaches the temperature at which slagging of inorganic material will occur in the pyrolysis chamber. The temperature in the pyrolysis chamber often rises above the slagging temperature due to the difficulty in maintain the temperature in the pyrolysis chamber. The inorganic components of the municipal waste then melt to form a tenaciously adhering coating of slag on all surfaces exposed to the waste. Because of the variance in composition and moisture content of municipal waste, it is essentially impossible to control the temperature for proper pyrolysis of the waste without avoiding increases in temperature that result in the slagging phenomenon.

Systems have been proposed for conversion of solid waste material by high temperature gasification into gaseous fuel called producer gas. Such a system usually comprises a vertically oriented chamber having sequentially descending drying, distillation, oxidation and reduction reaction zones. Again, due to large variances in the composition of the municipal waste as well as the moisture content of the waste, gasification systems have not been amenable to adequate control. These systems have been plagued with operational problems as well as serious pollution problems in the form of smoke and pollutants being emitted to the atmosphere. Unfortunately, gasification of municipal waste has not been used commercially to any great extent.

Most known gasification systems avoid fuels having a very high sulphur content, such as rubber. Experimental tests show that gasifying a 90 percent rubber waste stream with a 10% excess $O_2$ effluent stream creates conditions which produce 1100 ppm $SO_2$. Cutting the excess $O_2$ to 3.9% reduces the $SO_2$ a proportionate amount. The undesirable conditions that create excess $SO_2$ also create conditions for the formation of NOx. The presence of excess $O_2$ can be attributed to blow holes in the fuel bed. Blow holes create small isolated hot spots in the gasifier and, with excess $O_2$, promote the formation of NOx.

Environmental considerations mandate the removal of $SO_2$ and NOx in the effluent discharge gas of any combustion process of a commercial scale. This is a major concern of any combustion process and is of major economic concern in the design of the equipment. The higher the incidence of $SO_2$ and NOx downstream of the gasifier, the larger and more expensive the equipment needed to remove them. Thus, to reduce costs, high sulfur fuels are avoided.

The carbon content of the ash fraction is also an important consideration of the design and operation of a gasification system. Where once 20% to 50% carbon in the ash was common, now 3% to 5% carbon in the ash is desirable. Any form of indirect pyrolysis leaves large percentages of carbon in the ash primarily due to insufficient content of molecular oxygen to make the conversion from carbon to CO. Thus, pyrolysis is undesirable unless there is an economically viable use for the char.

To avoid excessive carbon content in the ash, sufficient oxygen must be admitted to the reaction chamber in the form of air (a mixture of gases), pure gaseous oxygen, or in the form of an oxygen rich solid. To be effective, gaseous oxidants must have intimate contact with the fuel carbon fraction for sufficient time to allow the reaction to take place. The velocity of the gases through the reaction chamber and the reaction path length determine the fuel bed size which can be used under desirable gasification conditions.

If the fuel bed is of optimum dimension and the path length through the reactor is sufficient for the oxidant to be fully reacted, there is still the problem of blow holes, or low resistance channels, through the bed unless the oxidant is administered at small differential pressures (low velocity) across the fuel bed. These low velocities make it very difficult to maintain the reaction at optimum temperatures, and they decrease fuel throughput and gas output for given reactor size. Although satisfactory results are obtained initially, the situation rapidly deteriorates over time because the oxidant can pass directly through the fuel bed into the output gas stream without reacting with the fuel.

From the foregoing, it will be appreciated that a fixed bed is not a good choice for the counter current reduction of municipal waste because of the incidence of excess oxygen which encourages the formation of $SO_2$. This is directly affected by the difficulty of obtaining a uniform fuel particulate size. One approach has been to agitate the bed with a paddle or series of paddles and or arms. This only agitates a portion of the fuel bed at any given time and still relies on a permeable fuel bed. If, during the reaction, the fuel becomes a very fine ash that promotes excess back pressure for the oxidant flow, then this stirred bed behaves as a fixed bed susceptible to blow hole formation.

A variation on the stirred bed is the use of a rotating table or tuyere beneath the bed. However, a rotating tuyere provides minimal fuel bed agitation in the higher zones and allows finer fuel and entrained ash particles to accumulate and interfere with the bed's overall permeability. As the permeability drops, back pressure on the oxidant supply rises until it forces its way through the bed. Thus, the fuel bed begins to exhibit lower resistance channels through the bed with characteristic high $SO_2$ and NOx output.

Neither of the conditions described above allows for a variation in fuel size or consistency that can be economically obtained with solid waste materials. To gasify a varied fuel source, like municipal, industrial, construction, and agricultural waste, the apparatus must be flexible enough to produce consistent results over a broad range of operating conditions. The permeability of the fuel bed is shown to be of primary concern and is affected adversely by changes in the fuel fraction that goes through a liquid stage when it encounters the temperatures within the gasifier. Another reason for variations in permeability are carbon fractions of paper that are fragile enough to be reduced to fine carbon particles with the least amount of agitation.

From the foregoing background, one would expect "fluidizing" conditions would be able to provide controllable intimate contact with such a varied fuel structure. Unfortunately, conventional fluidizing conditions provide excess oxygen which is not tolerable because of $SO_2$ and NOx production.

Another significant problem with conventional gasification devices is the inability to account for the wide variance in composition of the waste material as well as the variance in the moisture content of such waste. High water content waste can significantly reduce the operating temperature of the gasifyer. Wide variation in operating temperature affects makes it difficult to control the combustion of the waste material. Without adequate control, copious amounts of smoke and other deleterious pollutants are produced. Unless complicated and expensive procedures are utilized to capture the smoke and other pollutants, the smoke and pollutants are simply emitted to the atmosphere. Even when employing the complicated and expensive procedures for capturing smoke and other pollutants, inadvertent emissions of large amounts of smoke and pollutants are common.

The varying composition of solid waste, even without the moisture problem, makes it impractical to control waste gasification in a single reaction chamber. Municipal waste or refuse contains a significant amount of plastic and rubber materials that melt before burning. The melted materials tend to quench the combustion and can eventually stop the gasification process entirely. Again, large amounts of smoke and other pollutants are generated by this inability to adequately control the combustion of the waste material.

The following are some of the reasons that conventional apparatus for the gasification of solid fuel (wood and coal) will not consistently gasify municipal waste:

(a) Low fuel bed permeability or variations in permeability.

(b) High tendency to form channels through fuel bed structure.

(c) Fuel fines either in the raw fuel or created in the course of the process contributing to entrained particles in the effluent stream and permeability.

(d) High percentage of liquid phase materials and the variability in percentage of these materials.

(e) High initial moisture content of the fuel.

(f) Low gas terminal velocity to prevent particulate and large condensable agglomerations from being entrained.

Conventional gasifiers do not adequately address these parameters which must be dealt with on a continuously changing basis. Accordingly, it would be a significant advancement in the art to provide an apparatus and method for gasification of waste materials which do not promote $SO_2$ and NOx production.

Such apparatus and method for gasification of waste materials are disclosed and claimed herein.

SUMMARY OF THE INVENTION

The present invention provides an environmentally acceptable method and apparatus for gasification of waste materials, such as municipal, industrial, construction, and agricultural waste. The present invention may be readily adapted for gasifying conventional solid gasification fuels such as coal and wood. A preferred embodiment of the present invention provides such a method and apparatus for gasifying solid waste material wherein emission of smoke and other pollutants to the atmosphere is substantially eliminated.

The organic material in the waste material is converted to a relatively clean producer gas and a solid ash material. The ash has a volume typically less than about 20% of the volume of the starting waste material. The resulting solid ash material is sterilized and environmentally innocuous. The producer gas and the solid ash material can be used for various commercial purposes. For example, the ash can be used as a soil conditioner, for ice removal on highways, as a concrete additive, as a paving additive, and the producer gas can be used as a clean burning fuel. Alternatively, the gas can simply be burned and the ash can be buried in conventional fashion in a landfill.

A currently preferred apparatus for waste gasification according to the present invention includes a first and second combustion chamber. Waste material, which is preferably sorted, dried, and comminuted, is fed into the first combustion chamber. One currently preferred apparatus for feeding waste material into the first combustion chamber includes two conical feed valves which rotate about an axis of rotation and which move longitudinally along the axis of rotation. The feed valves allow accurate waste flow control and permit waste to be introduced into the first combustion chamber when it is operated under pressure.

The first combustion chamber includes a rotatable tuyere which supports an annular bed or column of waste material. The tuyere has a base portion and a central column extending from the base towards the feed valves. The cylindrical tuyere core in combination with the first combustion chamber interior wall define an annular region for the column of waste material. The height of the central column may be varied to increase or decrease the volume of the annular region. For low permeability waste material, the central column height (volume of the annular region) is preferably low. But for high permeability waste material, the central column height is preferably high.

An ash collection region for collecting ash removed from the bed or column of waste material is preferably located below the rotatable tuyere and the column of waste material. A plurality of angled vanes attached to the tuyere base facilitate removal of ash formed within the annular column of waste material. When the tuyere rotates on one direction, the angled vanes prevent the ash and waste material from entering the ash collection region, but when the tuyere is reversed, the angled vanes remove ash that has settled and collected within lower region of the waste material column.

A gaseous oxidizer is preferably introduced into the ash collection region via a path through the tuyere such that the oxidizer flows through the moving angled vanes and into the annular column of waste material. In this manner, the oxidizer is preheated and the oxidizer serves to cool the tuyere. Air is a convenient gaseous oxidizer which may be used. It is also within the scope of the present invention to include a solid oxidizer which is gasified under operating conditions.

The waste material feed rate and the gaseous oxidizer flow rate into the first combustion chamber are controlled to maintain a temperature within the first combustion chamber in the range from about 600° F. to about 2100° F. If a higher temperature is desired, then more waste material and oxidizer is fed to the first combustion chamber. If a lower temperature is desired, then less oxidizer and waste material is used. The choice of operating temperature will affect the resulting producer gas. For instance, it has been observed that lower temperatures result in gaseous combustion products having a high content of condensable hydrocarbons.

The first combustion chamber operates essentially in an updraft mode, that is, waste material is introduced into the upper portion, with combustion air being introduced into the lower portion of the first combustion chamber. Combustion gases move upwardly through the first combustion chamber and are fed from the upper portion of the first combustion chamber into the upper portion of the second combustion chamber.

The gases coming from the first combustion chamber contain a complex mixture of condensable hydrocarbon compounds which are referred to generally as tars. The gases further include methane and other hydrocarbon fuel gases, carbon dioxide, carbon monoxide, hydrogen, oxygen, water vapor, entrained carbon particles and a very small amount of finely divided hydrocarbonaceous material from the municipal waste material that was not completely burned in the first combustion chamber.

Combustion gases from the first combustion chamber are fed to the second combustion chamber. In a currently preferred embodiment within the scope of the present invention, particulates entrained in the combustion gases are separated and returned to the first combustion chamber for further processing.. A disc separator is one currently preferred device for separating particulates from the combustion gases and recirculating the particulates into the first combustion chamber.

The second combustion chamber includes a restricting orifice and a target downstream of the restricting orifice. The orifice has an opening that is smaller in cross-sectional area than a cross-sectional area of the second combustion chamber such that the combustion gases moving through said second combustion chamber pass through the restricting orifice. The target has an impingement surface that faces the restricting orifice. In one embodiment of the present invention, the target impingement surface is provided with grooves to produce a rough surface. In another embodiment, the target impingement surface is provided with rod-like projections extending toward the restricting orifice. The impingement surface is preferably larger than the restricting orifice so that combustion gases passing through the orifice impinge against the target's impingement surface.

An oxidizer is preferably introduced near the target to cause combustion reactions to occur at the target. In a preferred embodiment, an oxidizer is introduced directly into a permeable target. The oxidizer flow rate into the second combustion chamber is preferably controlled to maintain a target temperature in the range from about 1500° F. and 1850° F. A supplemental fuel may optionally be introduced into the second combustion chamber during start-up of the gasification process to heat the combustion chamber to a desired operating temperature.

In the second combustion chamber, the smoky, pollution-laden gases from the first combustion chamber are efficiently converted to a relatively clean producer gas. The producer gas from the second combustion chamber can either be recovered for its fuel value or it can be destroyed by being burned.

BRIEF DESCRIPTION OF THE DRAWINGS

Preferred embodiments of apparatus in accordance with the present invention representing the best mode presently contemplated of carrying out the invention is illustrated in the accompanying drawings in which.

DETAILED DESCRIPTION OF THE INVENTION

The present invention is directed to an apparatus and method for gasification of waste materials. The invention will be described in greater detail with reference to presently preferred embodiments thereof illustrated in the FIGS.

Figure 1:
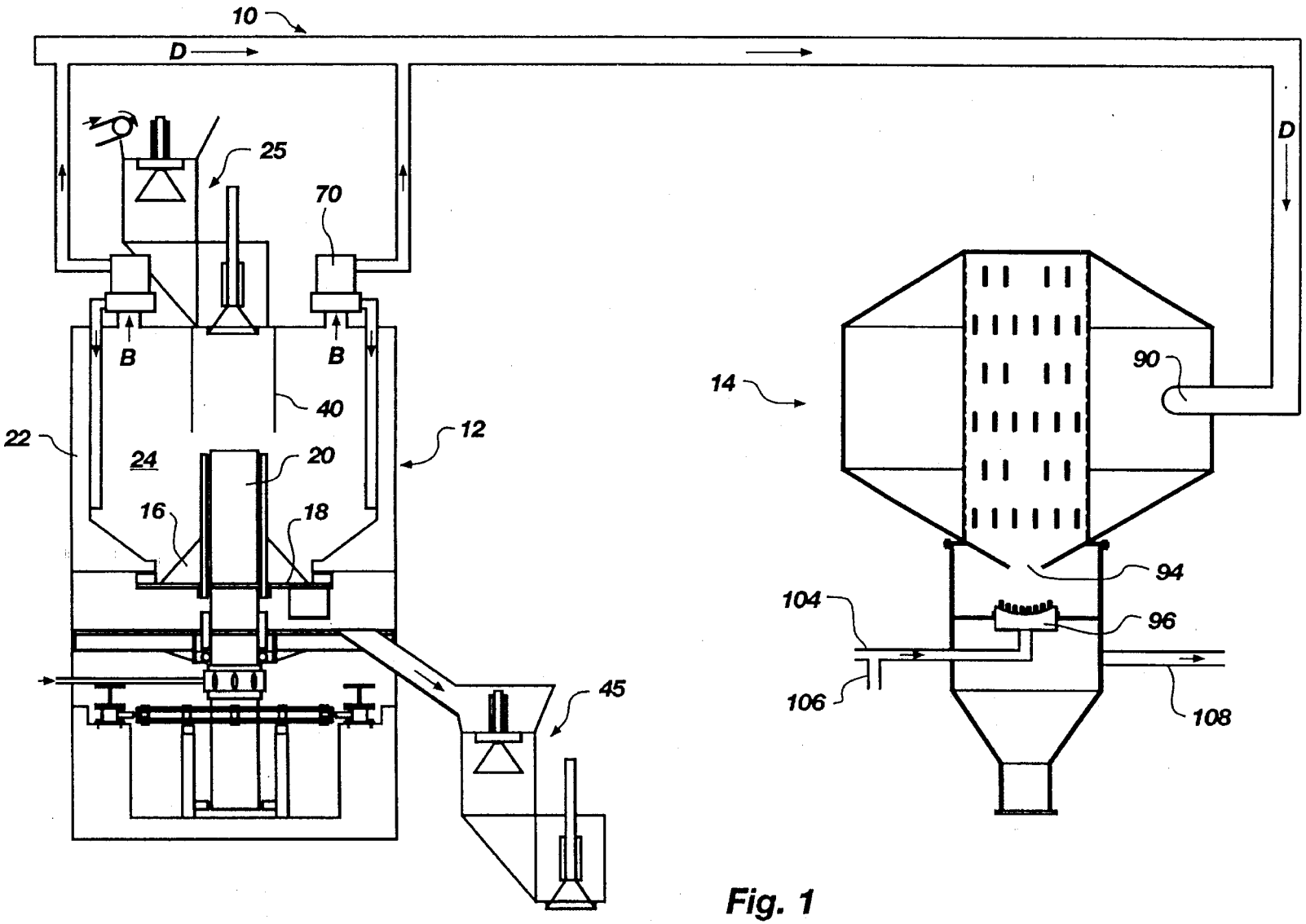
FIG. 1 is a diagrammatic, cross-sectional representation of a novel combustion apparatus useful in the process of gasifying waste material in accordance with the present invention.

Referring to FIG. 1, a currently preferred waste gasification system is generally designated 10. Waste gasification system 10 according to the present invention includes a first combustion chamber 12 and second combustion chamber 14.

Figure 2:
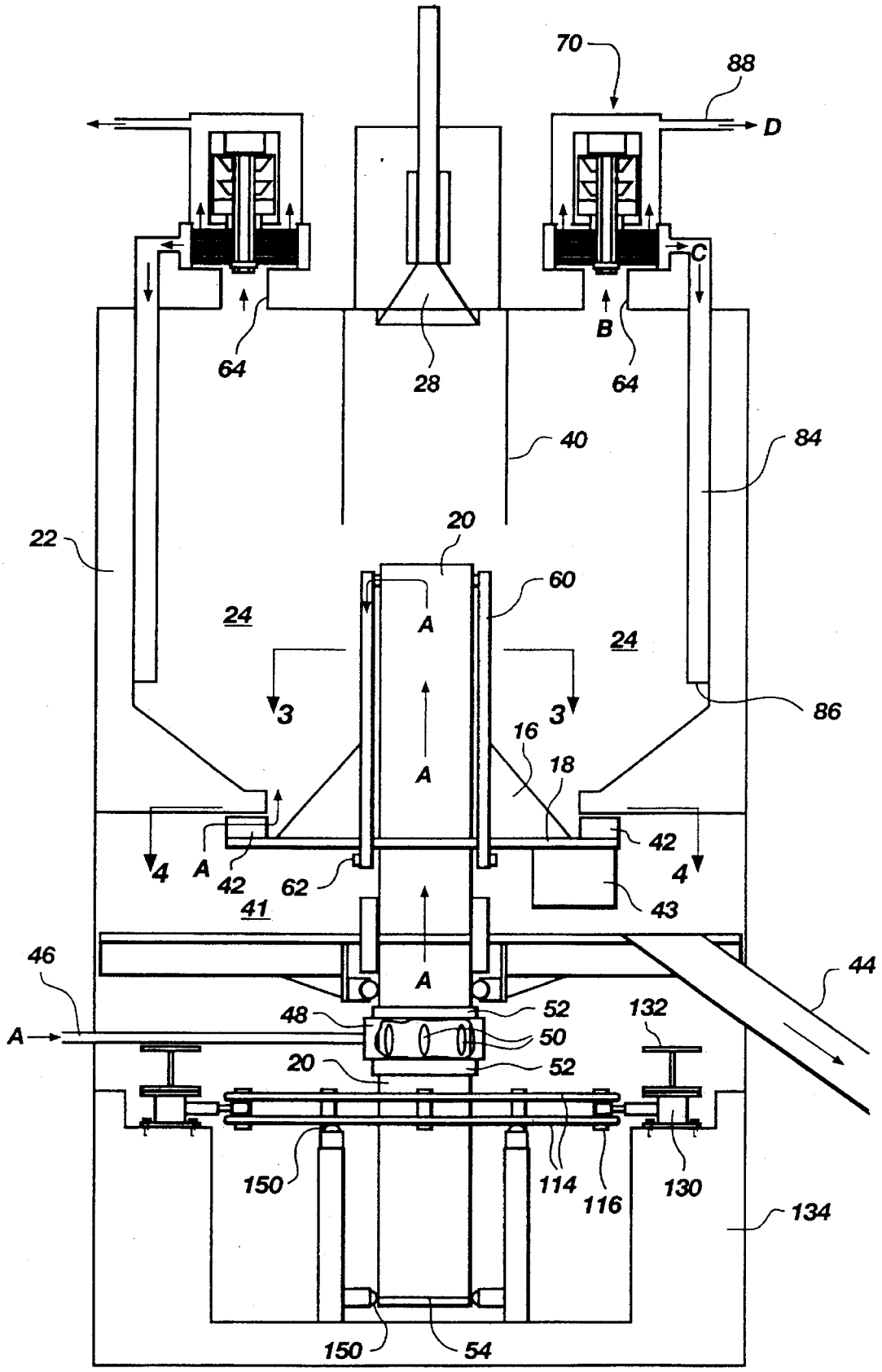
FIG. 2 is a detailed diagrammatic, cross-sectional representation of a first combustion chamber useful in the process of gasifying waste material in accordance with the present invention.
Figure 14:
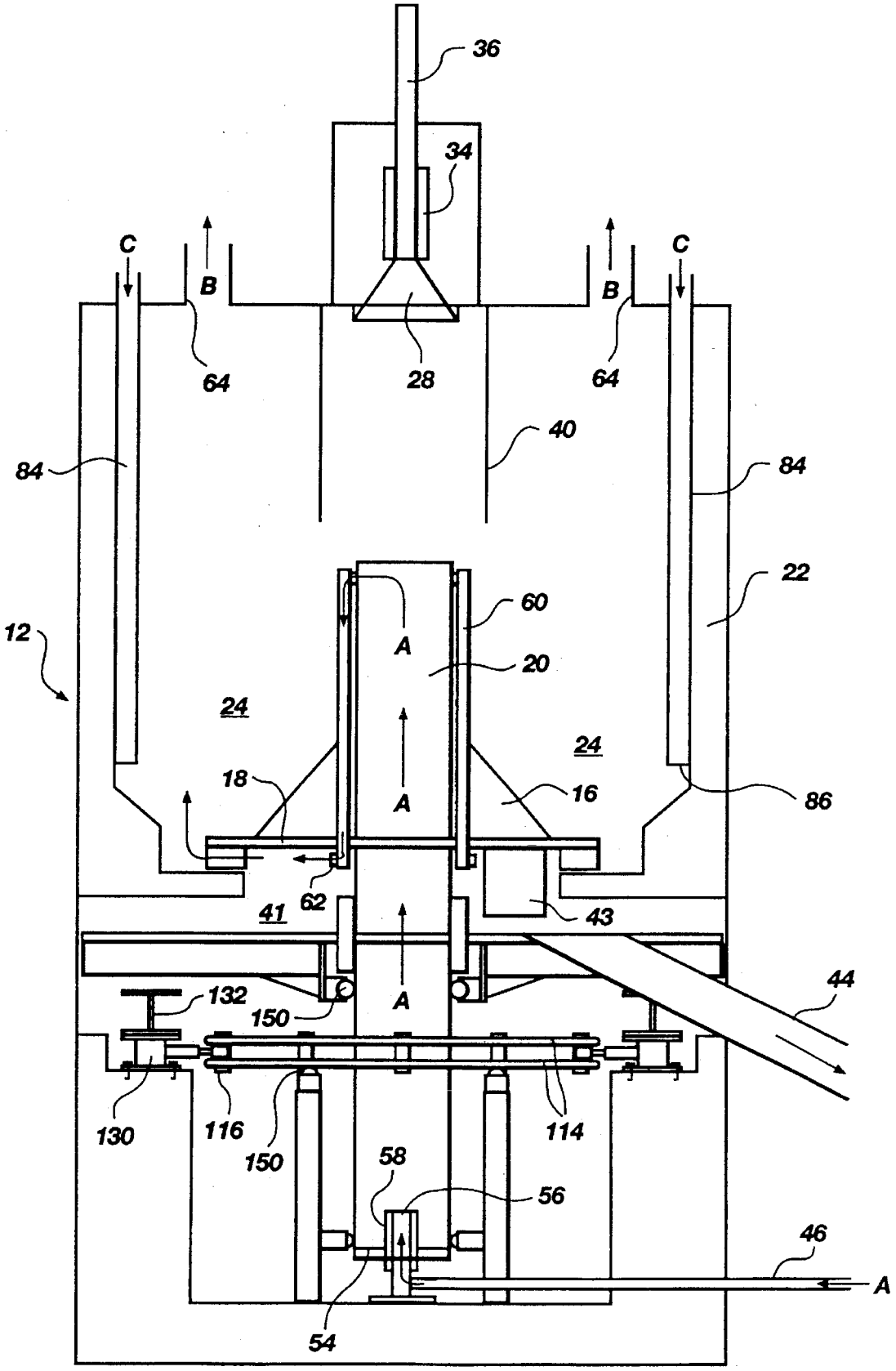
FIG. 14 is a detailed diagrammatic, cross-sectional representation of a first combustion chamber similar to that of FIG. 2 showing an alternative configuration of angled vanes attached underneath the rotatable tuyere base and alternative configuration for introducing gaseous oxidizer into the first combustion chamber.

The first combustion chamber 12, shown in greater detail in FIGS. 2 and 14, includes a rotatable tuyere 16 which supports an annular bed or column of waste material. The tuyere has a base portion 18 and a central column 20 extending upwardly from the base. The central column 20 in combination with the first combustion chamber interior wall 22 define an annular region 24 for the column of waste material. The height of central column 20 may be varied to increase or decrease the volume of the annular region 24. For low permeability waste material, the central column height (and corresponding annular region volume) is preferably low. But for high permeability waste material, the central column height is preferably high.

Waste material, which is preferably sorted, dried, and comminuted, is fed into the first combustion chamber using a feed valve system. As used herein, waste material includes municipal, industrial, construction, and agricultural waste materials, including tires. The present invention may also be used to gasify conventional solid fuels such as coal and wood. Thus, the term waste material used herein also includes coal and wood, even though coal and wood are not commonly considered waste materials.

Figure 13:
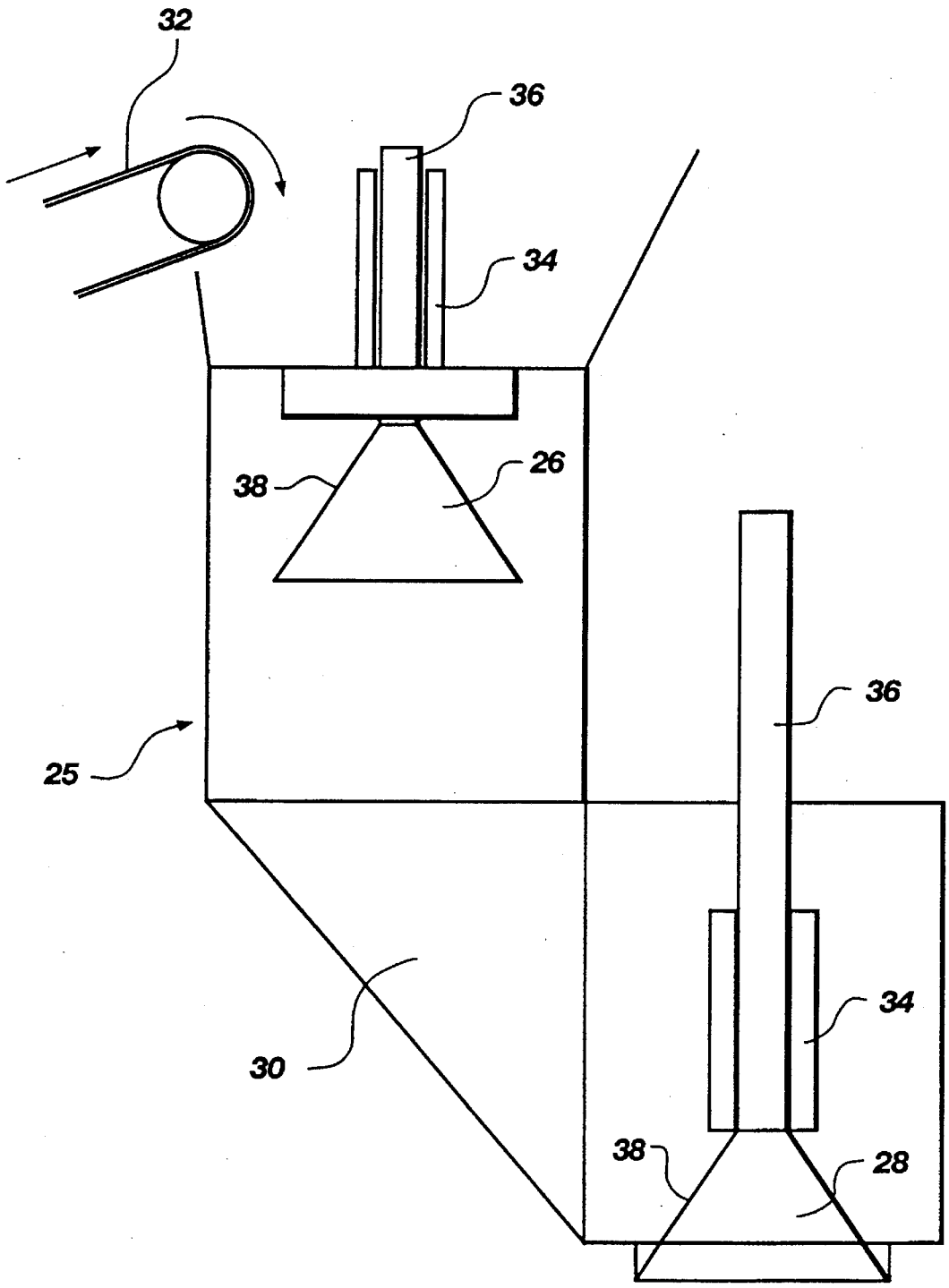
FIG. 13 is a diagrammatic, cross-sectional representation of waste feed valves.

One currently preferred apparatus for feeding waste material into the first combustion chamber is a feed valve system 25 such as that shown best in FIG. 13. The feed valve system 25 includes an upper feed valve 26 and a lower feed valve 28. When waste material is fed to the first combustion chamber 12, the lower feed valve 28 is preferably closed and the upper feed valve 26 is opened to admit waste material into a surge bin 30 located between the two feed valves. In one preferred embodiment, the surge bin 30 is configured to hold approximately 30 minutes of fuel before it must be refilled. Once a sufficient charge of waste material is fed to the surge bin, the upper feed valve 26 is closed and the lower feed valve 28 is opened to continue feeding waste material into the first combustion chamber 12. Waste material is carried from a waste storage area (not shown) to the first combustion chamber on a waste discharge belt 32. The discharge belt from the waste storage area and the opening and closing of the feed valves are, therefore, operated in a cyclic manner depending on the size of the surge bin 30 and the waste material processing rate.

The feed valve arrangement described herein is particularly useful when the gasification system is operated at an elevated pressure. By having two feed valves, at least one of the feed valves can be closed at all times to prevent pressurized combustion gases from escaping the gasification system.

To successfully move the solid waste material through the upper and lower feed valves, the valves preferably include agitating vanes 34 located on each valve stem 36 and optionally on each valve cone 38. The valve cones 38 are moved vertically and powered to rotate at a varying speed. The opening of the feed valve and its speed of rotation allow control of the feed rate of waste material through the feed valve. Means for opening and rotating the feed valves are not shown in the FIGS., but would be within the level of skill in the art.

When the waste material passes the lower feed valve 28 it is conveyed by gravity down a guide tube 40 into the annular region 24 in which the column of waste material is located. The purpose of the guide tube 40 is to prevent fine and or light waste material from becoming entrained in the exiting combustion gas stream from the column of waste material. This guide tube also allows for a variation of operation that would be required if the primary constituents of the waste fuel stream were light in weight for their volume or surface area which would allow them to be entrained in the counter moving gases from the column of waste material.

Figure 4:
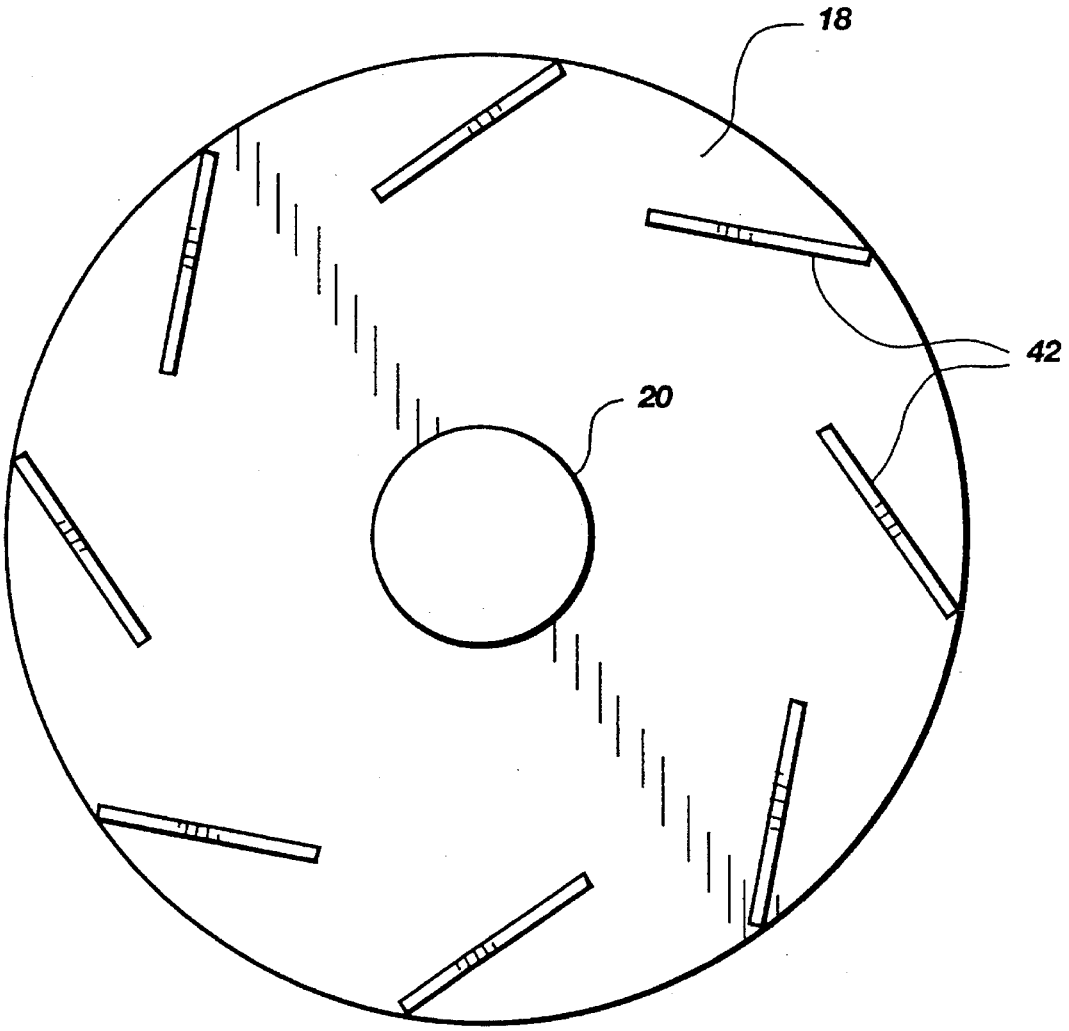
FIG. 4 is a cross-sectional view showing a plurality of angled vanes attached to the rotatable tuyere base which facilitate ash removal taken along line 4–4 of FIG. 2.

Once in the first combustion chamber 12, the waste material is gradually reduced to ash and gas. The ash settles to the lower region of the waste material column because of agitation created by the rotating tuyere 16 and gaseous oxidant moving up through the column. An ash collection region 41 for collecting ash removed from the column of waste material is preferably located below the rotatable tuyere 16 and the column of waste material. A plurality of angled vanes 42, shown best in FIG. 4, attached to the tuyere base 18, control the removal of ash formed within the annular column of waste material. When the tuyere rotates in one direction, the angled vanes prevent ash and waste material from entering the ash collection region 41, but when the tuyere is reversed, the angled vanes remove ash that has settled and collected within lower region of the waste material column. The angled vanes 42 may be attached to either the top or bottom side of the tuyere base 18 as shown in FIGS. 2 and 14.

An ash vane 43 attached below the rotatable tuyere 16 within the ash collection region 41, provides a sweeping rotation motion which moves the ash around until it falls down an ash chute 44 and into an ash valve system 45. The ash valve system is similar to the waste feed valve system 25 described above in connection with FIG. 13. However, an important distinction between the feed valve system and the ash valve system is that the upper ash valve is sealed to the atmosphere to permit removal of ash from the pressurized first combustion chamber.

A gaseous oxidizer is preferably introduced into the ash collection region 41 via a path through the tuyere such that the oxidizer flows between the moving angled vanes 42 and into the annular column of waste material. In this manner, the oxidizer is preheated by the tuyere and the tuyere is cooled by the oxidizer. Air is a convenient gaseous oxidizer which may be used. It is also within the scope of the present invention to introduce a solid oxidizer into the first combustion chamber which is gasified under operating conditions. FIGS. 2 and 14 illustrate two possible means for introducing gaseous oxidizer into the column of waste material.

As shown in FIG. 2, gaseous oxidizer enters the second combustion chamber 12 through an oxidizer feed line 46. The oxidizer feed line flows into an annular cavity defined by a collar 48. A plurality of openings 50 allow oxidizer inside the tuyere central column 20. Labyrinth seals 52 provide a gaseous seal between the collar 48 and the rotating tuyere central column 20. A plug 54 at the bottom of central column 20 prevents escape of the gaseous oxidizer.

As shown in FIG. 14, gaseous oxidizer enters the first combustion chamber 12 through an oxidizer feed line 46. The oxidizer feed line flows into the bottom of central column 20 through an injection tube 56 located within an opening in plug 54. Labyrinth seals 58 provide a gaseous seal between the injection tube 56 and the rotating plug 54 of central column 20.

Figure 3:
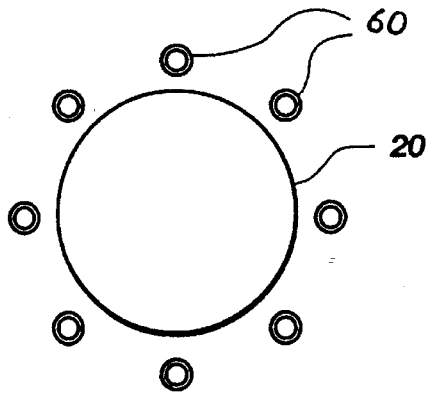
FIG. 3 is a cross-sectional view of the tuyere central column tuyere taken along line 3–3 of FIG. 2.

Arrows A, shown in FIGS. 2 and 14, illustrate typical gaseous oxidizer flow paths. Upon entering central column 20, gaseous oxidizer flows upward to the top portion of the central column and then downward through a plurality of peripheral tubes 60 attached to the exterior surface of the central column 20. FIG. 3 illustrates one possible configuration of peripheral tubes 60 surrounding central column 20. The peripheral tubes 60 have several important functions: (1) the tubes serve to preheat the gaseous oxidizer, (2) allowing gaseous oxidizer to flow through the peripheral tubes 60 serves to cool the tubes, and (3) the tubes assist in agitating the waste material as the tuyere rotates. As shown in FIGS. 1, 2, and 14, the peripheral tubes 60 extend below the tuyere base 18 and open into the ash collection region 41. An opening 62 is preferably provided at the end of each peripheral tube 60 which preferably opens laterally to minimize disturbance of ash within the ash region 41. The gaseous oxidizer then flows between the rotating angled vanes 42 and into the column of waste material located within the annular region 24.

The waste material feed rate and the gaseous oxidizer flow rate into the first combustion chamber are controlled to maintain a temperature within the first combustion chamber in the range from about 600° F. to about 2100° F. One currently preferred operating temperature is about 1850° F.± about 100° F. If a higher temperature is desired, then more waste material and oxidizer is fed to the first combustion chamber. If a lower temperature is desired, then less oxidizer and waste material is used. The choice of operating temperature will affect the resulting producer gas. For instance, it has been observed that lower temperatures result in gaseous combustion products having a high content of condensable hydrocarbons.

Although the waste gasification system has been described in connection with a vertical first combustion chamber 12, it will be appreciated that the principles and concepts of the present invention may be adapted to an inclined or even horizontal first combustion chamber.

Combustion gases leave the first combustion chamber 12 (shown by arrows B in FIGS. 1, 2, 5, and 14) towards the second combustion chamber 14. The combustion gases leaving the first combustion chamber include CO (carbon monoxide), $H_2$ (hydrogen), $CH_4$ (methane), some other lower alkyl compounds, condensable hydrocarbons (tar and oil), and particles of carbon and ash. The ash and carbon particles are entrained according to Stokes law, that is, the velocity of the gas leaving the waste material column determines the size entrained. The higher the velocity the larger the particles.

Figure 5:
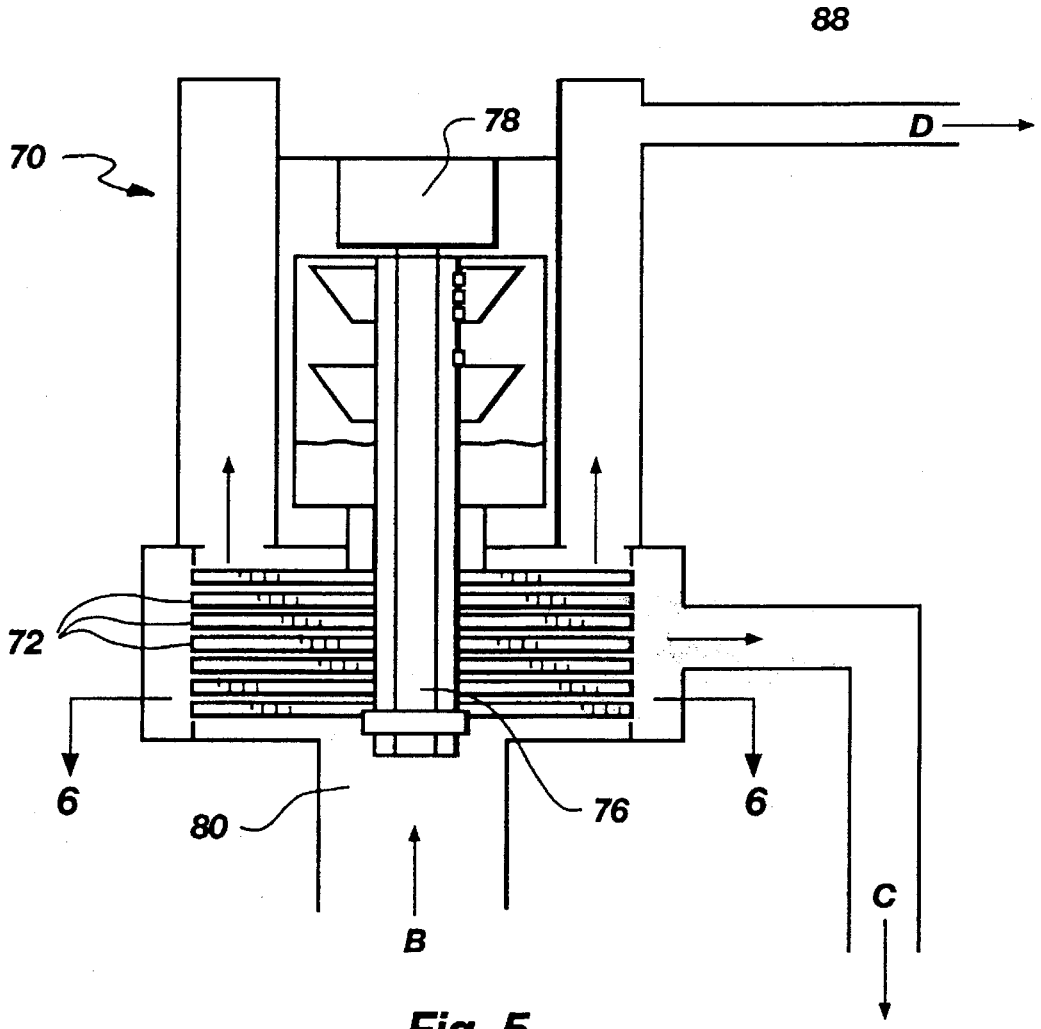
FIG. 5 is a detailed diagrammatic, cross-sectional representation of a disc separator for separating particulates from the combustion gases and recycling said particulates into the first combustion chamber.
Figure 6:
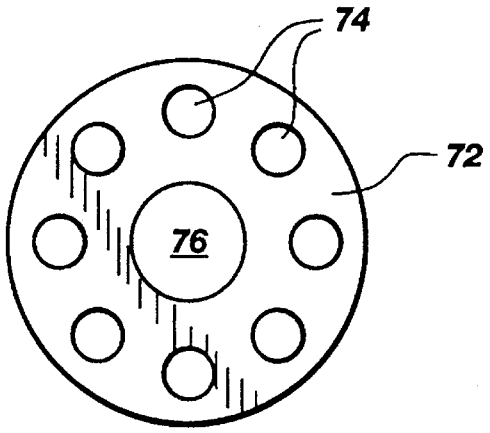
FIG. 6 is a cross-sectional view of a disc used in the disc separator of FIG. 5 taken along line 6–6 of FIG. 5.

Referring to FIGS. 1, 2, and 14, the combustion gases leave the first combustion chamber 12 through one or more gas outlets 64. In a currently preferred embodiment within the scope of the present invention, particulates entrained in the combustion gases are separated and returned to the first combustion chamber for further processing. A disc separator 70, shown in FIGS. 1, 5, and 6, is one currently preferred device for separating particulates from the combustion gases and recirculating the particulates into the first combustion chamber 12. The disc separator 70 includes a plurality of parallel rotating discs 72. The discs 72 include a plurality of holes 74, as shown in FIG. 6. The discs 72 are affixed to a rotatable shaft 76 which is rotated by a motor 78. In a currently preferred disc separator, the rotating discs have a ceramic surface to provide heat resistance. The discs may be coated with a ceramic material or the discs may be made of a ceramic material.

The number and size of rotating discs 72 may vary depending on the loading required. For instance, if low quantities of particulates are expected, a fewer number of discs are needed. In a currently preferred embodiment of the invention, from four to six discs having a diameter of about 30 inches are used. The discs typically rotate from about 500 to about 1500 rotations per minute.

Combustion gases from the first combustion chamber enter an annular inlet 80. The rotating discs 72 take advantage of the boundary layer effect on the discs to accelerate heavy condensables and particles at right angles to the gas stream having to negotiate the holes 74 placed in the rotating discs 72 before reaching the discharge. The configuration of the disc separator has the effect of preventing a low velocity exit path for the combustion gases which would allow the gases to carry off a high percentage of particles and condensables. Instead these heavier fractions are exhausted along a recirculation path (arrows C) and are routed to recirculation injection tubes 84 shown in FIGS. 1, 2, and 14. The recirculation injection tubes 84, which can be of any cross-section (square, round, etc.), provide passage to a recirculation outlet 86. The recirculation outlet 86 is preferably located in the lower regions of the column of waste material where there is primarily carbon char which oxidizes giving high temperatures. The recirculation rate serves to regulate the waste material column temperature because these recirculated particulates absorb energy as they are gasified and moderate temperatures in the column. Thus, controlling the recirculation rate is another way of controlling the temperature within the first combustion chamber 12.

The portion of the combustion gases that pass through the rotating discs 72 leave the disc separator 70 through a discharge outlet 88, also shown at arrow D, and enter the second combustion chamber 14 through inlet 90. The second combustion chamber 14 finishes gasifying any light condensables and particles which may still be entrained in the gas. The second combustion chamber 14 includes a restricting orifice 94 and a target 96 downstream of the restricting orifice 94. The orifice 94 has an opening that is smaller in cross-sectional area than a cross-sectional area of the second combustion chamber 14 such that the combustion gases moving through said second combustion chamber pass through the restricting orifice 94. The target 96 has an impingement surface 98 that faces the restricting orifice 94.

Figure 8:
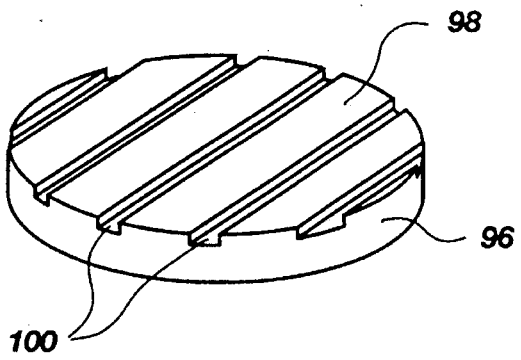
FIG. 8 is a perspective view of a possible target for use in a second gasification chamber such as that illustrated in FIG. 7.
Figure 9:
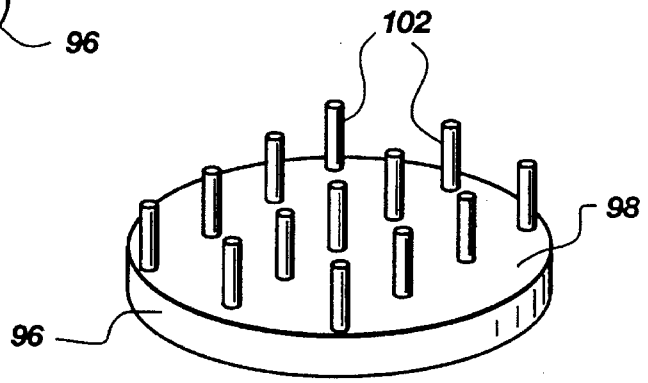
FIG. 9 is a perspective view of a possible target for use in a second gasification chamber such as that illustrated in FIG. 7.

In one embodiment, shown in FIG. 8, of the present invention, the target impingement surface 98 is provided with grooves 100 to produce a rough surface. In another embodiment, shown in FIG. 9, the target impingement surface 98 is provided with rod-like projections 102 extending toward the restricting orifice. The impingement surface 98 is preferably larger than the restricting orifice so that combustion gases passing through the orifice impinge against the target's impingement surface.

An oxidizer is preferably introduced into the second combustion chamber 14 through an oxidizer inlet 104. The oxidizer inlet preferably introduces oxidizer at a location near the target 96 to cause partial combustion reactions to occur at the target. This has the effect of heating the target to a high temperature, typically greater than about 1500° F. In a presently preferred embodiment, shown in FIG. 7, the oxidizer is introduced directly into a permeable or porous target. As the gas stream impacts the target, particulates and condensables are stalled, which leaves them in a high temperature zone for a longer period and allows them a greater opportunity to gasify. The oxidizer flow rate into the second combustion chamber is preferably controlled to maintain a target temperature in the range from about 1500° F. and 1850° F.

Figure 7:
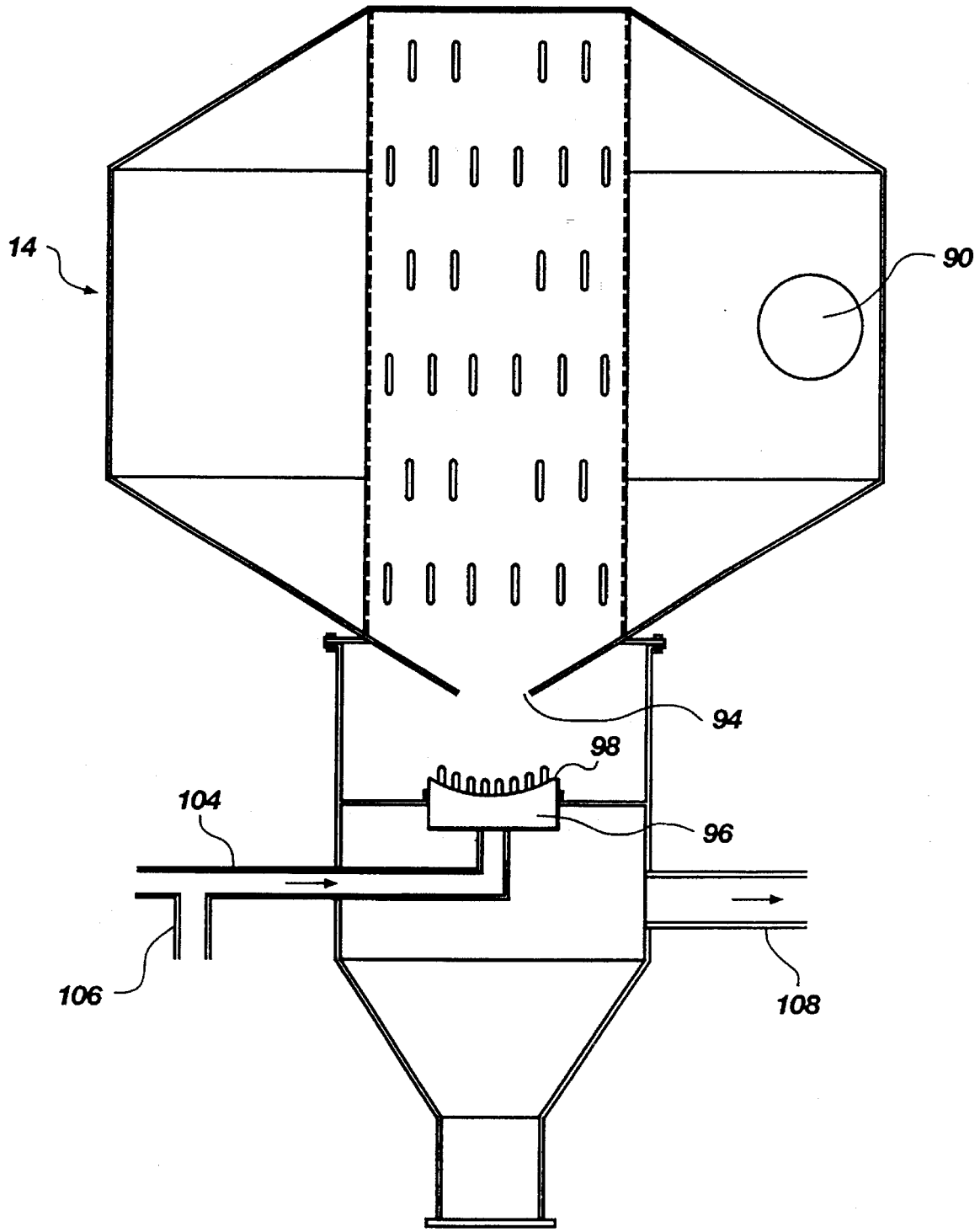
FIG. 7 is a detailed diagrammatic, cross-sectional representation of a second gasification chamber useful in the process of gasifying waste material in accordance with the present invention.

A supplemental fuel may optionally be introduced into the second combustion chamber during start-up of the gasification process to heat the combustion chamber to a desired operating temperature. A fuel feed line 106 is shown in FIG. 7 for this purpose.

Figure 15:
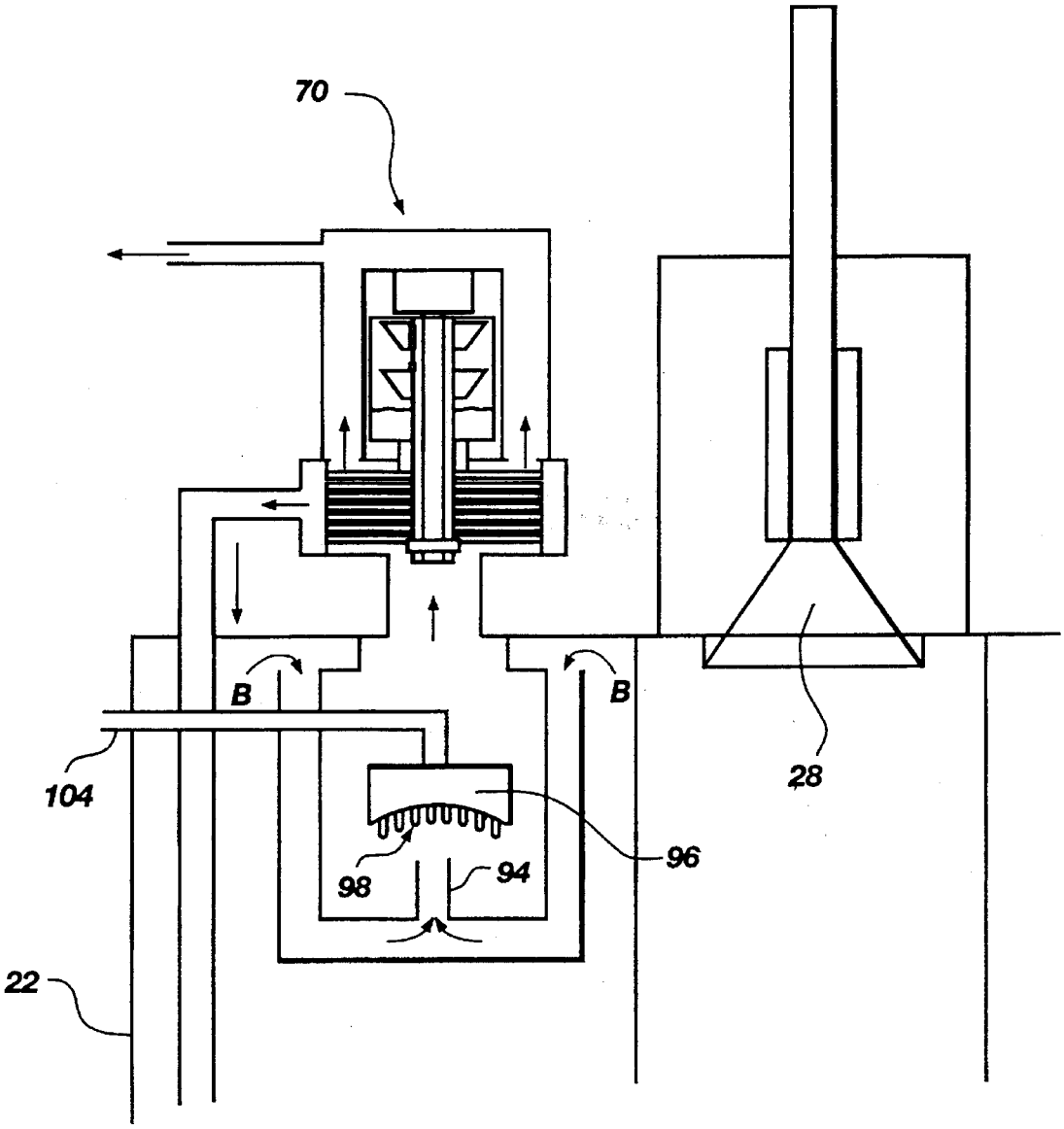
FIG. 15 is a digrammatic, cross-sectional representation of a second combustion chamber located within the first combustion chamber.

FIG. 15 illustrates an embodiment within the scope of the present invention in which the second combustion chamber is located within the first combustion chamber. As shown in FIG. 15, combustion gases, designated by arrows B, enter a second combustion chamber and pass through a restricting orifice 94, striking an impingement surface 98 of target 96. An oxidizer inlet 104 is provided similar to that illustrated in FIG. 7. The combustion gases then enter a disc separator 70 similar to the device illustrated in FIGS. 5 and 6.

After passing through the second combustion chamber 16, the combustion gases are withdrawn as a relatively clean producer gas through producer gas outlet 108. On leaving the second combustion chamber, the hot producer gas is preferably passed through one or more heat exchangers (not shown) to recover the heat and to promote condensation of condensable hydrocarbons. The heat removed from the producer gas may be used to dry raw waste material. The producer gas is then optionally processed with conventional pollution control devices, where necessary, to remove any remaining pollutants before being discharged into the atmosphere.

It is also within the scope of the present invention to introduce reactants that effectively reduce the nitrogen content of the combustion gases. For example, compounds known in the art for catalyzing the thermal disassociation of water and of oxygen-rich compounds, may be introduced into the waste gasification system.

An important feature of the gasification system according to the present invention is the use of a tuyere which creates a rotating annular column within the first combustion chamber. Although, various means for rotating the rotatable tuyere are within the level of skill in the art, two currently preferred means for rotating the tuyere are disclosed in FIGS. 10 and 12. A hydraulic, piston driven system is shown in FIG. 10 and a more conventional motor driven chain drive system is shown in FIG. 12.

Figure 10:
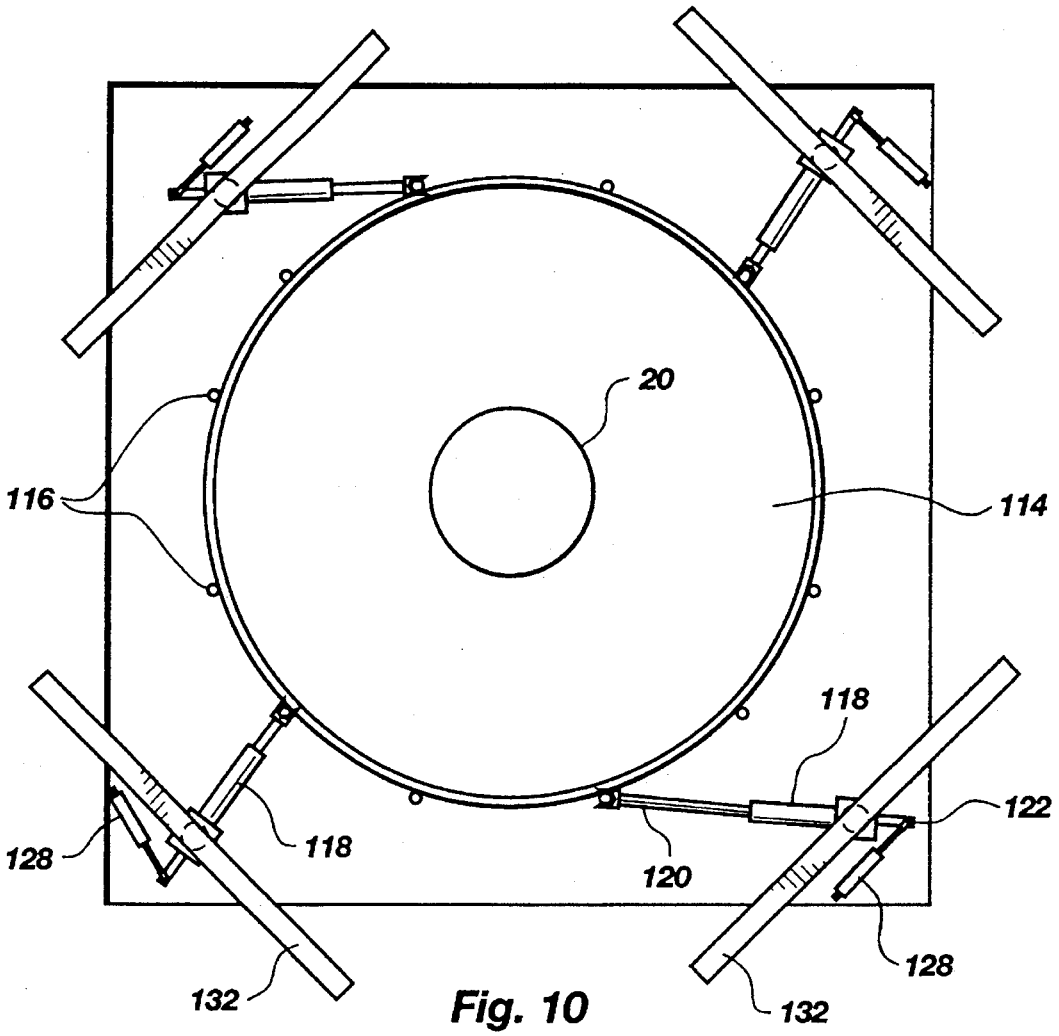
FIG. 10 is a top view of a tuyere drive system using a plurality of hydraulic pistons.
Figure 11:
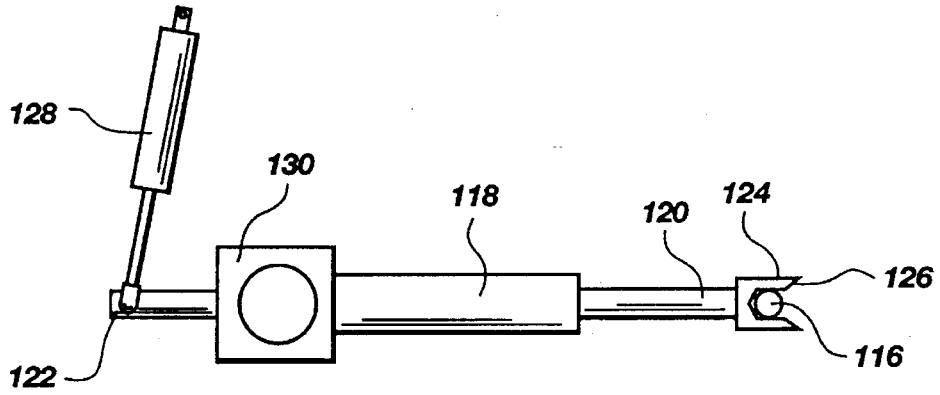
FIG. 11 is a detailed top view of a hydraulic piston for use in the tuyere drive system of FIG. 10.

Referring to FIGS. 10, 11, and the cross-sectional views of FIGS. 2 and 14, a pair of drive wheels 114 are secured to the tuyere central column 20. The drive wheels 114 contain a plurality of drive pins 116 located about the exterior circumference of the drive wheels. A plurality of hydraulic cylinder rods 118, preferably arranged in pairs, are positioned around the drive wheels 114. Each hydraulic cylinder rod 118 has an engagement end 120 and a pivot end 122. An engagement yoke 124 is located at the engagement end of each hydraulic cylinder rod for engaging the drive pins. The engagement yokes preferably have chamfered edges 126 to facilitate engagement and to force yoke alignment upon engagement. A hydraulic pivot cylinder 128 is connected to the pivot end 122 of the hydraulic cylinder rod 118. A pivot journal 130, located between the engagement end 120 and pivot end 122 of the hydraulic cylinder 118, is affixed to an immovable structural support. For instance, in a preferred embodiment of the invention, the pivot journal 130 is anchored above to an "I" beam 132 and below to the floor 134 or foundation of the combustion chamber. The "I" beams 132 are also preferably anchored to prevent movement.

In operation, the yoke 124 engages a drive pin 116, and the hydraulic cylinder rod 118 extends to rotate drive wheels 114. The hydraulic cylinder rod 118 pivots about the pivot journal 130, and the pivot cylinder 128 positions and aligns the hydraulic cylinder rod 118 during each engagement cycle. The hydraulic cylinder rods 118 are preferably operated in pairs such that cylinder rods on opposite sides of the drive wheels 114 operate together. Various timing sequences are available in the art to provide high torque and variable speed operation.

Figure 12:
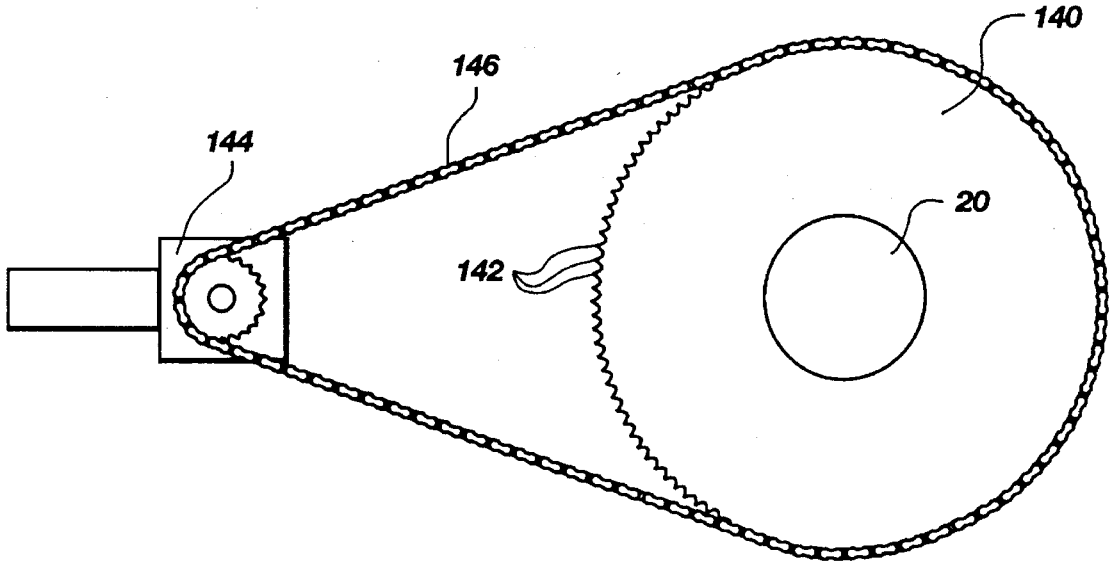
FIG. 12 is a top view of a tuyere drive system using a motor driven chain assembly.

FIG. 12 illustrates a conventional drive train mechanism useful for rotating tuyere 16. In operation, a cogged drive wheel 140 is secured to the tuyere central column 20. The cogged drive wheel 140 contains a plurality of cogs 142 located about the exterior circumference of the drive wheel 140. A motor 144 is provided for driving a chain 146 which engages the cogs of drive wheel 140. Tuyere rotation speed and direction is control by controlling the motor 144.

As shown best in FIGS. 2 and 14, a plurality of cartridge bearings 150 are positioned around the tuyere central column 20 to maintain the rotating column in a stable vertical alignment. A plurality of cartridge bearings 150 are also provided underneath drive wheel 114 to support the weight of the rotatable tuyere 16. Although not shown in FIGS. 2 and 14, it is possible to place bearings at the top of the central column 20 if the central column is lengthened.

An important advantage of the rotating tuyere described herein is the ability to have a rotating annular column of waste material which causes vertical shearing throughout the waste material. The waste material agitation causes fluidizing conditions through a much longer reaction path (the annular column height) than is possible with other agitation or cell design schemes. This fluidizing condition is created at low oxidant pressures through a consistently defined channel that is created within the annular column of waste material. Control of the tuyere speed permits control of the agitation and fluidizing conditions favorable to waste gasification nearly independent of the oxidizer pressure and waste volume.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claimed invention is:

1. A method of waste gasification comprising the steps Of:

(a) feeding waste material into a first combustion chamber, said combustion chamber having a rotatable tuyere with a central column extending from a base of the tuyere toward a means for feeding the waste material, the tuyere supporting an annular column of waste material;

(b) introducing an oxidizer into the column of waste material;

(c) rotating the rotatable tuyere so as to shear the annular column of waste material;

(d) igniting the waste material within the first combustion chamber;

(e) controlling the feed rate of the waste material and of the oxidizer so as to maintain a temperature within the first combustion chamber in the range from about 600° F. to 2100° F.;

(f) withdrawing combustion gases from an upper portion of the first combustion chamber often passing upwardly therethrough and feeding the combustion gases to a second combustion chamber, said second combustion chamber including a restricting orifice smaller in cross-sectional area than the cross-sectional area of the second combustion chamber, such that the combustion gases pass through said restricting orifice and strike a target provided downstream of the restricting orifice, said target having an impingement surface that faces the restricting orifice;

(g) introducing an oxidizer into the second to cause combustion reactions to occur at the target combustion chamber near the target;

(h) withdrawing a relatively clean producer gas from the second combustion chamber.

2. A method of waste gasification as defined in claim 20, wherein the waste is sorted before being fed into the first combustion chamber.

3. A method of waste gasification as defined in claim 1, wherein the waste is dried before being fed into the first combustion chamber, such that the waste contains less than about 10% moisture by weight.

4. A method of waste gasification as defined in claim 1, further comprising the steps of separating particulates and condensable hydrocarbons from the combustion gases and recirculating said particulates and condensables into the first combustion chamber.

5. A method of waste gasification as defined in claim 4, wherein the particulates are separated from the combustion gases by a plurality of rotating discs.

6. A method of waste gasification as defined in claim 1, wherein the waste material is fed into the first combustion chamber using at least two conical feed valves which are each rotatable about an axis of rotation and which are longitudinally movable along their respective axis of rotation.

7. A method of waste gasification as defined in claim 1, further comprising the step of withdrawing ash from the first combustion chamber.

8. A method of waste gasification as defined in claim 7, wherein the ash is removed from the first combustion chamber using at least two conical ash valves which are each rotatable about an axis of rotation and which are longitudinally movable along their respective axis of rotation.

9. A method of waste gasification as defined in claim 1, wherein the oxidizer is introduced into the column of waste material by passing a gaseous oxidizer through the column of waste material.

10. A method of waste gasification as defined in claim 1, further comprising the step of preheating the gaseous oxidizer introduced into the first combustion chamber.

11. A method of waste gasification as defined in claim 1, further comprising the step of cooling the rotatable tuyere.

12. A method of waste gasification as defined in claim 1, further comprising the step of feeding a fuel into the second gasificatioh chamber.

13. A method of waste gasification as defined in claim 1, further comprising the step of controlling the oxidizer flow rate into the second combustion chamber so as to maintain a temperature within said second combustion chamber in the range from about 1500° F. and 1850° F.

* * * * *